US006655341B2

(12) United States Patent
Westerbeke, Jr.

(10) Patent No.: US 6,655,341 B2
(45) Date of Patent: Dec. 2, 2003

(54) OIL SUMP FOR VERTICALLY SHAFTED ENGINES

(75) Inventor: John H. Westerbeke, Jr., Milton, MA (US)

(73) Assignee: Westerbeke Corporation, Taunton, MA (US)

( * ) Notice: Subject to any disclaimer, the term of this patent is extended or adjusted under 35 U.S.C. 154(b) by 0 days.

(21) Appl. No.: 10/023,630

(22) Filed: Dec. 17, 2001

(65) Prior Publication Data

US 2002/0088425 A1 Jul. 11, 2002

Related U.S. Application Data

(60) Provisional application No. 60/256,717, filed on Dec. 19, 2000.

(51) Int. Cl.[7] ..... F01M 1/00
(52) U.S. Cl. ..... 123/196 R
(58) Field of Search ..... 123/196 R, 195 P, 123/195 C, 196 W, 196 S; 440/88, 89, 900; 290/1 A

(56) References Cited

U.S. PATENT DOCUMENTS 4,383,828 A * 5/1983 Wynne ..... 440/69
4,540,888 A 9/1985 Drewry et al.
4,695,261 A 9/1987 Broughton et al.
4,779,905 A 10/1988 Ito et al.
4,836,123 A 6/1989 Grinde et al.
4,859,886 A 8/1989 Tanaka et al.
5,041,034 A 8/1991 Sakamoto
5,370,563 A 12/1994 Yamazaki et al.
5,694,895 A 12/1997 Tsunoda et al.
5,904,604 A 5/1999 Suzuki et al.
5,954,016 A * 9/1999 Westerbeke, Jr. ..... 123/41.18
5,989,084 A 11/1999 Tsunoda et al.
6,012,956 A * 1/2000 Mishima et al. ..... 440/88
6,149,478 A 11/2000 Lehmann
6,190,221 B1 * 2/2001 Nanami ..... 440/88
6,283,808 B1 * 9/2001 Lehmann ..... 440/88

* cited by examiner

*Primary Examiner*—Henry C. Yuen
*Assistant Examiner*—Hyder Ali
(74) *Attorney, Agent, or Firm*—Fish & Richardson P.C.

(57) ABSTRACT

An oil sump for a vertically shafted combustion engine has a housing with an upper face for sealing against a block of the engine. The sump housing defines an internal volume for containing a quantity of oil received from the engine through an oil drain opening in the upper face of the sump, and defines an exhaust inlet for receiving a flow of exhaust from the engine and directing the flow of exhaust toward an exhaust outlet along an exhaust passage defined within the housing. The housing also defines a water inlet for receiving a flow of cooling water into a water passage within the housing about the exhaust passage. The sump also includes means for securely mounting the engine within a boat hull. In some marine applications, seawater or fresh water coolant is discharged into the exhaust gas stream at an attached exhaust elbow.

32 Claims, 6 Drawing Sheets

OIL SUMP FOR VERTICALLY SHAFTED ENGINES

REFERENCE TO RELATED APPLICATIONS

This application claims the benefit of provisional patent application No. 60/256,717, filed Dec. 19, 2000, the contents of which are incorporated herein by reference as if fully set forth.

TECHNICAL FIELD

This invention relates to oil sumps for vertically shafted engines, and to adapting outboard marine motor engines for use in marine generator sets.

BACKGROUND

Outboard marine motors have been developed over several decades to become a mature technology, with commercially available units mass produced by various manufacturers to be cost-effective means for driving propellers on small to medium sized watercraft. The typical outboard marine motor has a gas-powered engine operating on either a two-stroke or four-stroke combustion cycle to turn a vertical crankshaft that extends below the water line to engage and drive a propeller. The engine is commonly encased in a housing that encloses the engine and provides means for mounting the motor outboard of the transom of a boat. The housing also generally supports the drive shaft between engine and propeller, provides a sump for lubricating oil (in the case of four-stroke engines), and ports exhaust gases and cooling seawater downward from the engine.

SUMMARY

Although such motors have been available for several years, their use on boats has generally been limited to their primary intended application: turning propellers. I have realized that engines from such motors can be usefully modified to drive on-board electrical generators, and have filed a provisional patent application on Nov. 7, 2000, entitled "Electrical Power Generation, serial No. 60/246,554, the entire contents of which are hereby incorporated by reference as if entirely set forth.

The present invention features an improved oil sump useful for such modification.

According to one aspect of the invention, an oil sump for a vertically shafted combustion engine has a housing with an upper face for sealing against a block of the engine. The sump housing defines an internal volume for containing a quantity of oil received from the engine through an oil drain opening in the upper face of the sump, and defines an exhaust inlet for receiving a flow of exhaust from the engine and directing the flow of exhaust toward an exhaust outlet along an exhaust passage defined within the housing. The sump housing also defines a water inlet for receiving a flow of cooling water into a water passage defined within the housing about the exhaust passage for cooling the flow of exhaust.

In another aspect, the present invention features an improved, combination oil sump and engine mount useful for modifying an outboard motor engine for use in other applications. In this aspect, the sump housing further comprises means for securely mounting the engine within a boat hull. In some cases, the mounting means include one or more mounting holes for receiving removable fasteners for securely mounting the engine within a boat hull. The mounting holes can be through holes defined in lugs extending from the sump housing, or blind and tapped holes extending into the sump housing.

The alternator or generator may be of several types known in the art, but for some applications a variable speed, permanent magnet alternator is preferred. Such alternators are commonly used in generating electrical power from wind-driven turbines, for example, and can be equipped with power conditioning circuitry to provide a stable output frequency over a wide range of input speeds. An advantage of variable speed operation is that the engine can be configured to change speeds in response to load, to maintain an optimum operating efficiency and to enable the use of advantageously small, less powerful engines.

By "rotor" I mean the rotating portion of the alternator, whether carrying electrical windings as an armature, or carrying magnets.

In some embodiments, the permanent magnet alternator is coupled to the engine to run at a relatively constant, "synchronous" speed (e.g., 1800 RPM), to produce a desired output frequency. Such a configuration is appropriate for applications that will accommodate some variation in output voltage over a range of operational loads and temperatures. One advantage of this configuration is that it employs a much simpler alternator architecture than that of a wound generator stator with exciter circuits, for example, without the added expense of solid state frequency generation circuitry.

According to another aspect of the invention, a method of producing electrical power on-board a boat is provided. The method includes the steps of attaching the above-described oil sump to the block of an outboard motor engine, attaching the crankshaft of the engine to an electrical generator, mounting the engine and generator on-board a boat, and running the engine to produce electrical power, and directing electrical power from the generator to a remote electrical load, such as an electrical appliance or on-board power grid, to perform useful work.

According to another aspect of the invention, a method of modifying a vertically shafted outboard motor engine is provided. The method includes the step of mounting the above-described sump to a lower face of the engine. In some embodiments, a pulley is attached to the exposed end of the engine crankshaft within the vertical profile of the sump, for driving a vertically-shafted alternator.

The sump housing is preferably very low profile, such as less than about five inches deep (more preferably, less than about 3.5 inches deep), in order to package the engine and sump within typical low overhead spaces. The sump also provides side clearance to the engine crankshaft for belting or otherwise side-coupling the crankshaft to the alternator rotor in a side-by-side mounting arrangement, preferably within the vertical profile of the sump itself, or to other belt-driven devices such as a seawater pump.

Preferably, the internal volume of the sump accommodates an oil volume at least as large as the volume of oil accommodated by the outboard motor housing in which the engine was designed to be packaged. In many cases, the sump should accommodate at least about 60 cubic inches of engine oil.

This invention can facilitate the use of conventional outboard motor engines in applications for which such engines were not intended when designed and manufactured. Particularly, this invention facilitates the mounting of such engines on-board boats, rather than in outboard motor housings, and the coupling of such engines to electric alternators for the generation of useful electrical energy rather than the turning of a propeller. In many applications, this advantageous conversion of outboard motor engines is accomplished without any substantive modification of the engine's internal components or block, thereby maintaining the high reliability that such engines have been designed to achieve. The resulting engine-generator set can provide cost-effective electrical power generators of a physical size and power rating particularly needed by some boat owners, particularly those with moderate to low power requirements and who prefer a system that can be permanently mounted below deck and out of sight, rather than mounted outboard, exposed to direct salt spray and less secure from theft.

Some aspects of the invention can provide for the ready modification of outboard motor engines for use in running electrical generators, without having to modify any principal engine components or compromise engine structural rigidity. The sump can be mounted directly to the lower face of the engine block in place of a standard oil sump, employing a gasket or other type of face seal to the lower edge of the block. The sump can be made to accommodate a desired oil volume, with appropriately placed drain passages from the engine block for recirculating the engine oil. The improved sump can also be provided with structural mounting bosses to secure the engine to a frame mounted within a boat hull. The sump can direct a flow of seawater or other cooling water about the exhaust coming from the engine, to cool the exhaust to more manageable temperatures before the exhaust leaves the sump, where the exhaust and water streams can be joined for further exhaust cooling. Internal porting of the seawater can also be made to cool the lubricating oil housed within the sump, and to insulate the lubricating oil from the heat of the exhaust.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
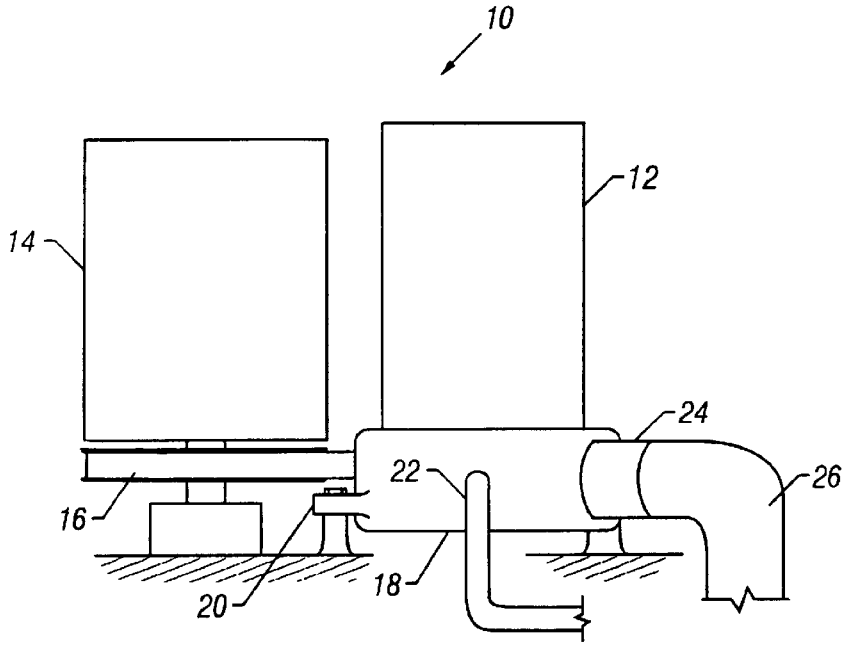
FIG. 1 is a conceptual illustration of an outboard engine equipped with my improved oil sump and driving an electrical generator.

Referring first to FIG. 1, a marine electrical generator set 10 for use on a boat includes a gasoline-powered outboard motor engine 12 coupled to an alternator 14 through a flexible belt 16. Engine 12 has an oil sump 18 attached at its lower end, by which it is mounted to the hull of the boat. In this illustration, one mounting lug 20 is shown, although multiple mounting points will generally be required, the pattern of which will be dictated by each application. Sump 18 also has an inlet 22 for cooling water, and an exhaust outlet 24. Cooling water can, for example, be seawater pumped into the sump at inlet 22 by a positive displacement pump (not shown) driven by engine 12. The cooling water is directed into a jacket about the exhaust stream of the engine in sump 18, and then exits the sump into exhaust elbow 26, where it is combined with the exhaust stream.

The physical structure of a single preferred embodiment of sump 18 is shown in the remaining figures. This particular embodiment is designed for ready attachment to the block of the engine of a Tohatsu four-stroke 15 horsepower outboard motor. Other embodiments are similar in concept and function, but will differ in the arrangement and location of various elements, as dictated primarily by the fixed design of the outboard motor engine block and packaging constraints.

Sump 18 may be cast from aluminum, with minor machining required at interface points. A suitable material for improved salt resistance is ALMAG 35.

Figure 2:
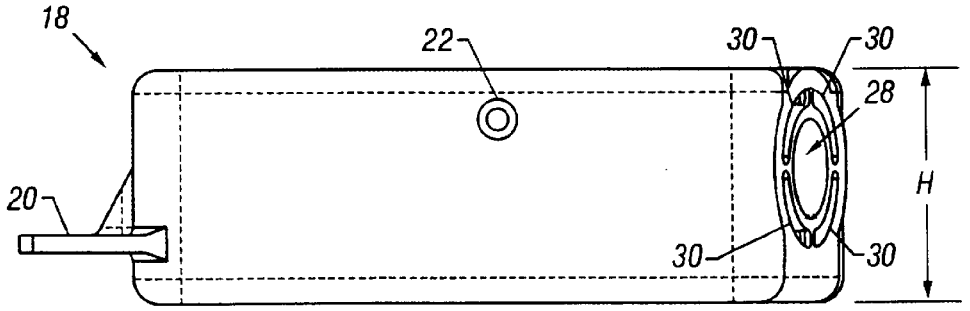
FIGS. 2 and 3 are front and back views, respectively, of the oil sump.

Referring to FIG. 2, outlet 24 of sump 18 defines a central exhaust passage 28 surrounded by water passages 30. These passages align with corresponding passages (not shown) in cooling elbow 26 (FIG. 1), in which the passages are joined to produce a single combined stream. The entire sump has a height "H" of only about 3.5 inches, enabling the vertical packaging of the sump and engine in many below-deck generator applications, while accommodating about 60 cubic inches of oil.

Figure 3:
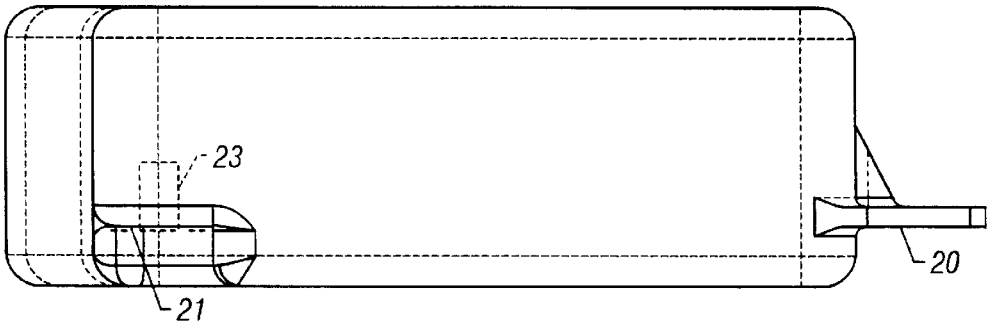
Figure 4:
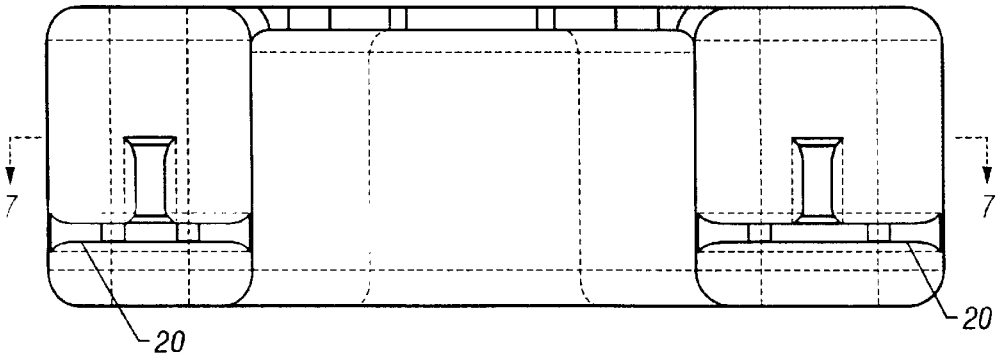
FIG. 4 is a left side view of the oil sump.

FIGS. 3 and 4 are included to show other external views of sump 18, and the location of two mounting bosses 20 and one mounting pad 21, such that the preferred embodiment secures the engine to a fixed structure on-board the boat at three mounting points defining a horizontal plane. Extending inward from pad 21 is a blind tapped hole 23, shown in dashed outline in FIG. 3. In other embodiments, the engine mounting means provided by the sump may include one or more of the mounting lugs or bosses 20 and pads 21 shown, either alone or in combination with one or more mounting points provided on other parts of engine 12. The lugs and pads are secured to the boat by removable fasteners, either rigidly or through intermediate cushioning material to dampen vibrations. Engine 12 and alternator 14 may be rigidly mounted to a single frame, which is then resiliently secured to the boat hull to dampen vibration. In many cases, both the engine and alternator will be enclosed in a single enclosure (not shown) for improved sound insulation and safety.

Figure 5:
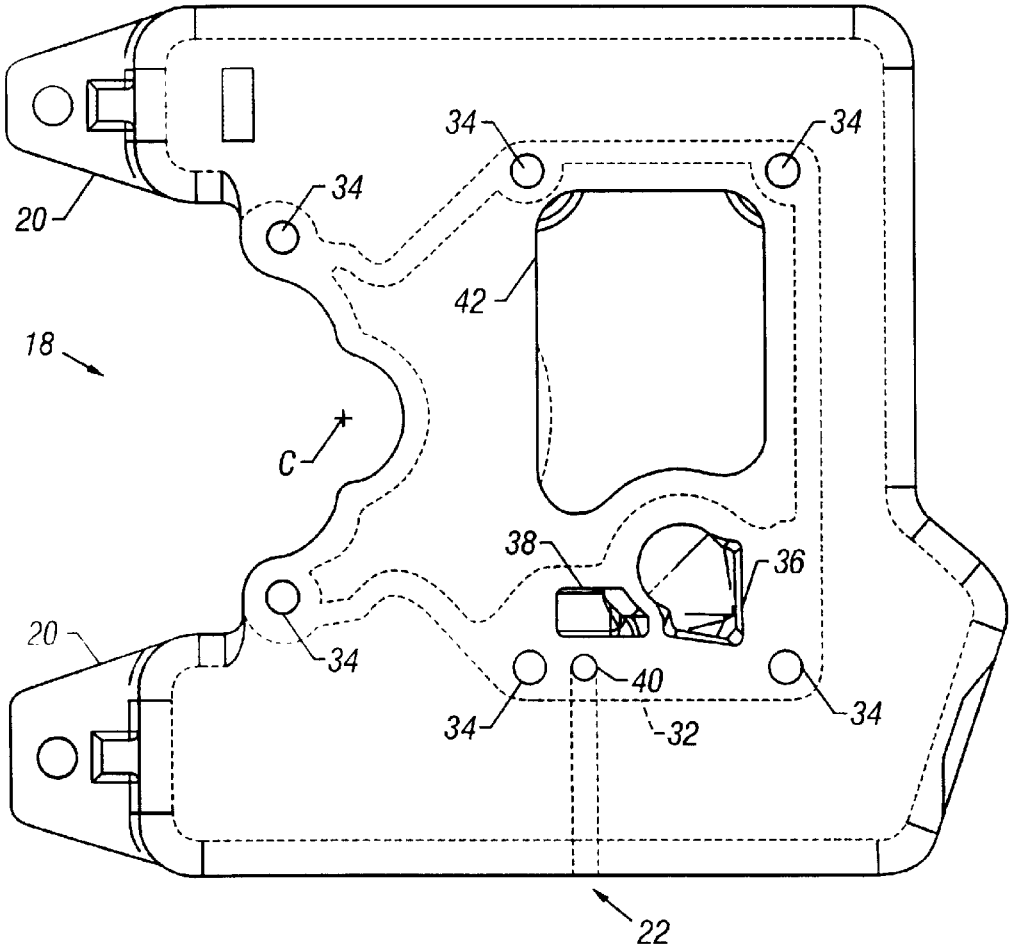
FIG. 5 is a top view of the oil sump (as seen from the engine).

The top view in FIG. 5 shows, in dashed outline, the planar area 32 against which the lower face of the engine block is to be sealed, by way of gasket or other sealant. Six mounting holes 34 align with the original sump mounting holes of the engine block. Area 32 also seals about an exhaust inlet opening 36, a cooling water outlet 40 for directing seawater from inlet 22 up into the engine block, and a cooling water inlet 38 for receiving the same flow of cooling water after it has been circulated through the engine block. A central oil drain opening 42 ensures that the primary internal volume of the sump is in open communication with the lower portion of the engine block for receiving lubricating oil and to enable the sump to be installed on the engine block without removing the original engine oil pump. Although only one drain oil opening 42 is shown, in many cases multiple openings will be required to insure drainage from all engine cavities.

Figure 6:
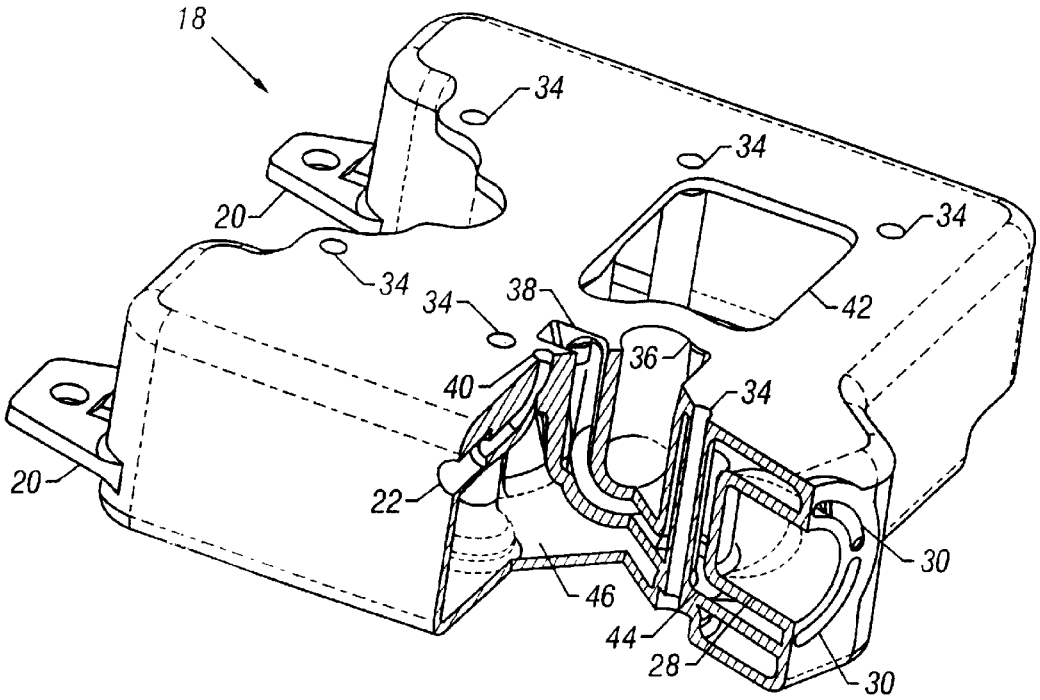
FIG. 6 is a perspective view of the oil sump, with one corner removed to show inner passages.
Figure 7:
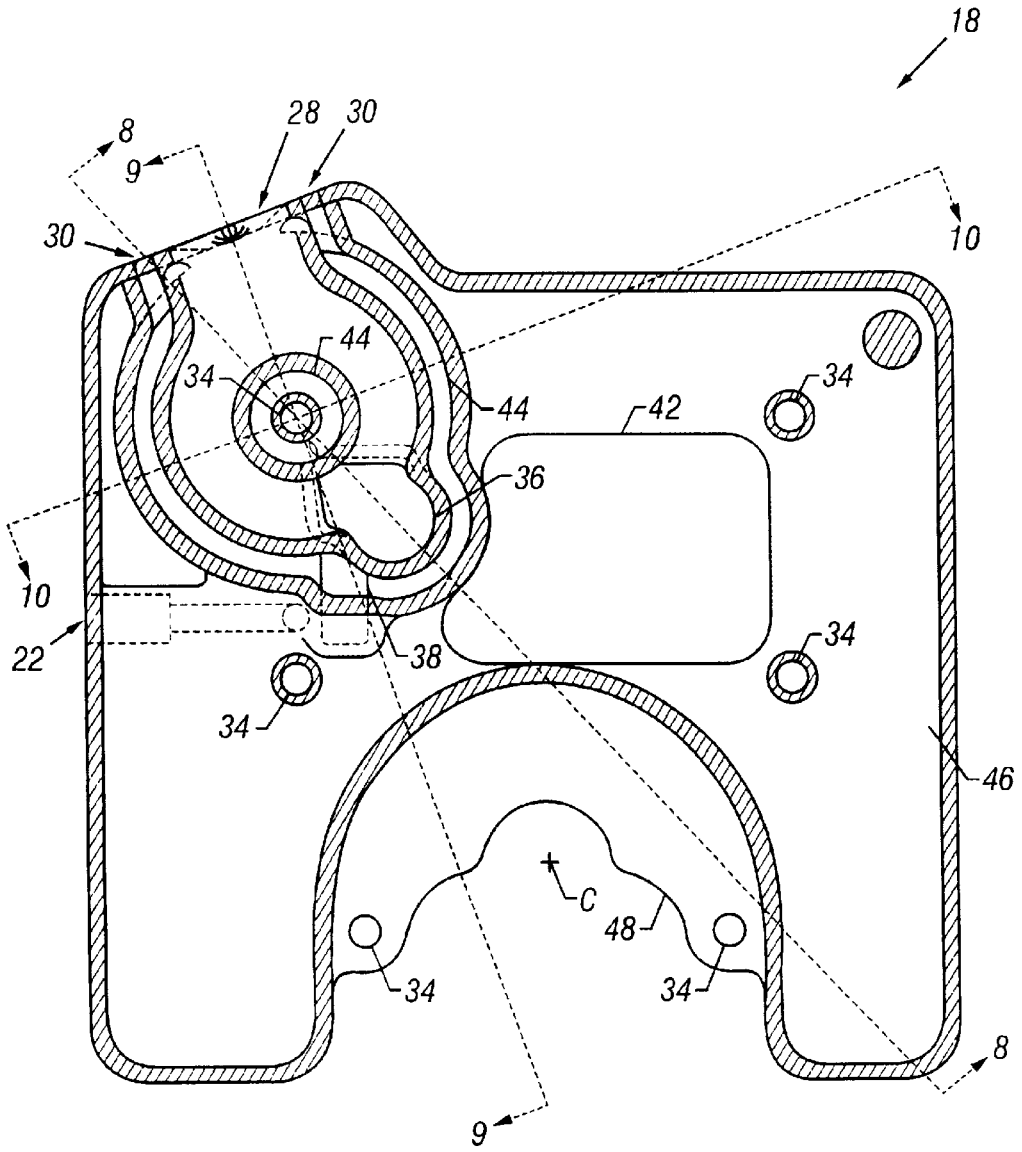
FIG. 7 is a cross-sectional view, taken along line 7—7 in FIG. 4.

FIG. 6 shows some of the detail of the internal passages of sump 18, as well as the internal columns about engine mounting holes 34. Cooling water returning from the engine through port 38 flows into an internal jacket 44 about exhaust passage 28. Referring also to FIG. 7, water jacket 44 also extends between bifurcated exhaust passage 28 and the columnar structure defining one of mounting holes 34. Water jacket 44 functions to cool the exhaust flow within the sump, while also cooling the lubricating oil in the sump and insulating the oil from the exhaust heat.

FIG. 7 also shows the location "C" of the centerline of the engine crankshaft, and how the primary internal volume 46 of sump 18 (indicated by the cross-hatched vertical walls about the sump perimeter) is relieved about point C to provide adequate clearance for a pulley or other drive coupling. For use with engines not capable of withstanding the side loads such a belt drive system would place on the cantilevered crankshaft, sump flange 48 can be provided with a bearing (not shown) for supporting the crankshaft. Alternatively, the sump housing may be structurally configured to support a crankshaft bearing (not shown) at the distal end of the crankshaft, outboard of the pulley.

Figure 8:
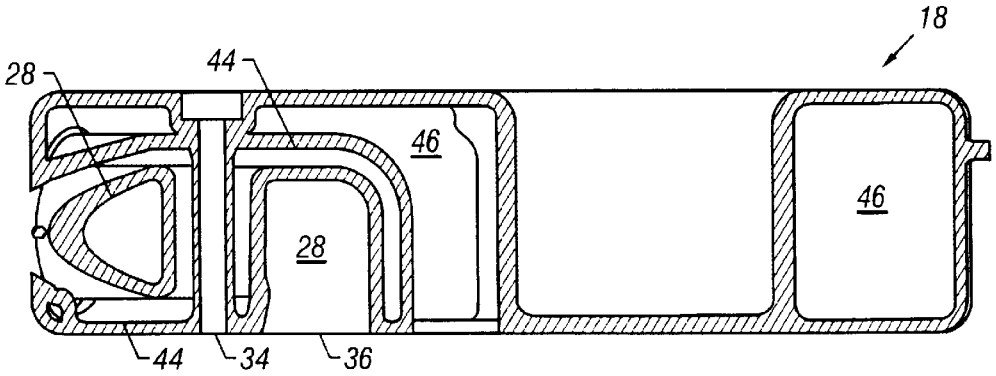
FIGS. 8, 9 and 10 are cross-sectional views, taken along lines 8—8, 9—9 and 10—10, respectively, in FIG. 7.
Figure 9:
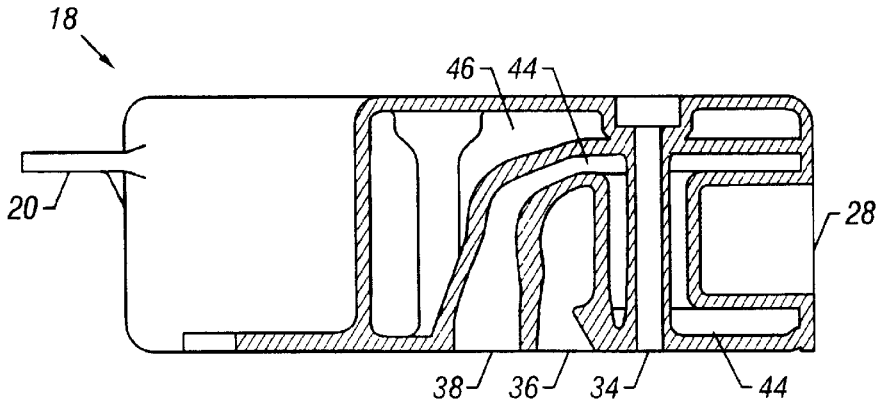
Figure 10:
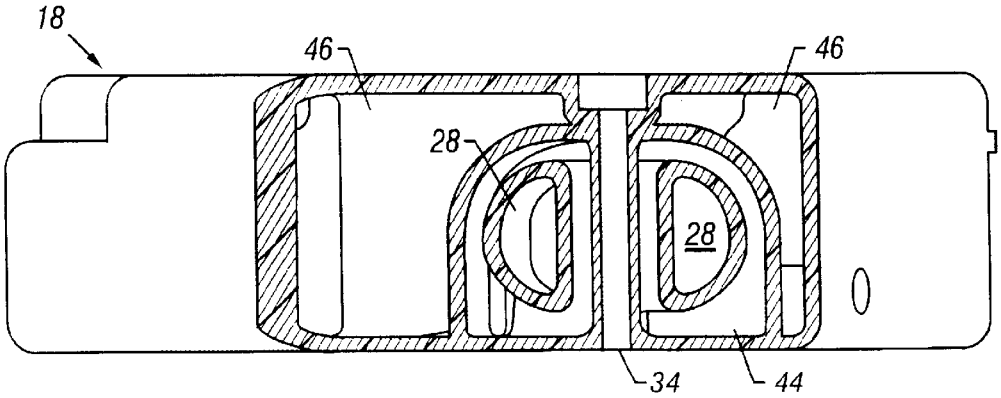

FIGS. 8–10 are various cross-sections taken through the internal passage structure to illustrate the arrangement of the various internal passages within the sump.

A single preferred embodiment of the invention has been described in detail. Nevertheless, it will be understood that various modifications may be made without departing from the spirit and scope of the invention. Accordingly, other embodiments are within the scope of the following claims.

What is claimed is:

1. An oil sump for a vertically shafted combustion engine, the oil sump having a housing with an upper face for sealing against a lower face of a block of the engine defining an internal volume therein for containing a quantity of oil received from the engine through an oil drain opening in the upper face of the sump;

defining an exhaust inlet for receiving a flow of exhaust from the engine and directing the flow of exhaust toward an exhaust outlet along an exhaust passage defined within the housing; and defining a water inlet for receiving a flow of cooling water into a water passage defined within the housing about the exhaust passage;

the sump further comprising means for securely mounting the engine within a boat hull.

2. The oil sump of claim 1 wherein the mounting means includes multiple mounting holes for receiving removable fasteners for resiliently mounting the engine within the boat hull at multiple points.

3. The oil sump of claim 2 wherein the mounting holes comprise through holes defined in lugs extending from the sump housing.

4. The oil sump of claim 2 wherein the mounting holes comprise blind and tapped holes extending into the sump housing.

5. The oil sump of claim 1 wherein the means for mounting is configured to secure the engine to a fixed structure at three discrete mounting points defining a plane.

6. The oil sump of claim 1 wherein one side of the sump defines a recess configured to provide clearance for a pulley secured to a lower end of a crankshaft of the engine and disposed within a vertical profile of the sump.

7. The oil sump of claim 1 wherein the exhaust outlet of the sump is surrounded by cooling water outlets extending from the water passage.

8. The oil sump of claim 1 wherein the housing has an overall vertical profile, below said upper face, of less than about five inches.

9. The oil sump of claim 8 wherein the overall vertical profile is less than about 3.5 inches.

10. The oil sump of claim 1 wherein the internal volume accommodates at least about 60 cubic inches of engine oil.

11. The oil sump of claim 1 wherein the water passage is disposed between the exhaust passage and said internal volume, so as to insulate engine lubricating oil from exhaust heat.

12. A combination oil sump and engine mount housing having an upper face for sealing against a block of a vertically shafted engine, the housing defining an internal volume therein for containing a quantity of oil received from the engine through an oil drain opening in the upper face of the housing;

an exhaust inlet for receiving a flow of exhaust from the engine and directing the flow of exhaust toward an exhaust outlet along an exhaust passage defined within the housing;

a water inlet for receiving a flow of cooling water into a water passage defined within the housing about the exhaust passage for cooling the flow of exhaust; and holes spaced apart across the housing and adapted to receive fasteners for resiliently securing the engine within a boat hull at multiple mounting points.

13. The combination oil sump and engine mount housing of claim 12 wherein the holes comprise through holes defined in lugs extending from the housing.

14. The combination oil sump and engine mount housing of claim 12 wherein the holes comprise blind and tapped holes extending into the housing.

15. The combination oil sump and engine mount housing of claim 12 wherein the holes are arranged to secure the housing to a fixed structure at three discrete mounting points defining a plane.

16. The combination oil sump and engine mount housing of claim 12 wherein two of the mounting holes are disposed on opposite sides of a recess extending inward from a side of the housing and sized to provide clearance for a pulley secured to a lower end of a crankshaft of the engine and disposed within a vertical profile of the sump.

17. The combination oil sump and engine mount housing of claim 12 wherein the exhaust outlet of the housing is surrounded by cooling water outlets extending from the water passage.

18. The combination oil sump and engine mount housing of claim 12 having an overall vertical profile, below said upper face, of less than about five inches.

19. The combination oil sump and engine mount housing of claim 18 wherein the overall vertical profile is less than about 3.5 inches.

20. The combination oil sump and engine mount housing of claim 12 wherein the internal volume accommodates at least about 60 cubic inches of engine oil.

21. A marine generator assembly comprising a combustion engine having a vertically disposed crankshaft;

an electric generator with a rotor connected to the crankshaft for rotation; and an oil sump secured to a lower end of the engine and defining an internal volume therein for containing a quantity of oil received from the engine through an oil drain opening in an upper face of the sump;

an exhaust inlet for receiving a flow of exhaust from the engine and directing the flow of exhaust toward an exhaust outlet along an exhaust passage defined within the sump;

a water inlet for receiving a flow of cooling water into a water passage defined within the sump about the exhaust passage for cooling the flow of exhaust; and holes spaced apart across the sump and adapted to receive fasteners for resiliently securing the engine within a boat hull at multiple mounting points.

22. The marine generator assembly of claim 21 wherein the rotor is connected to the crankshaft by a belt.

23. The marine generator assembly of claim 21 wherein a lower end of the engine crankshaft has a pulley disposed within a vertical profile of the sump.

24. The marine generator assembly of claim 21 wherein the sump has an overall vertical profile, below the engine, of less than about five inches.

25. The marine generator assembly of claim 24 wherein the overall vertical profile is less than about 3.5 inches.

26. The marine generator assembly of claim 21 wherein the holes are arranged to secure the sump to a fixed structure at three discrete mounting points defining a plane.

27. A method of producing electrical power on-board a boat, the method comprising attaching an oil sump to a lower face of a block of an outboard motor engine, the oil sump comprising a housing defining an internal volume therein for containing a quantity of oil received from the engine through an oil drain opening in the upper face of the housing;

an exhaust inlet for receiving a flow of exhaust from the engine and directing the flow of exhaust toward an exhaust outlet along an exhaust passage defined within the housing;

a water inlet for receiving a flow of cooling water into a water passage defined within the housing about the exhaust passage for cooling the flow of exhaust; and holes spaced apart across the housing and adapted to receive fasteners for resiliently securing the engine within a boat hull at multiple mounting points;

attaching a crankshaft of the engine to an electrical generator;

mounting the engine and generator on-board a boat;

attaching the water inlet to a source of cooling water; and running the engine to turn the generator to produce electrical power.

28. The method of claim 27 wherein the cooling water is seawater.

29. The method of claim 27 wherein the engine is mounted with its crankshaft extending vertically.

30. The method of claim 27 wherein attaching the crankshaft of the engine to the generator includes attaching a pulley to a lower end of the engine crankshaft, so as to dispose the pulley within a vertical profile of the sump.

31. The method of claim 27 wherein attaching the crankshaft of the engine to the generator includes wrapping a belt about both a first pulley secured to the crankshaft and a second pulley secured to a rotor of the generator, with the rotor and crankshaft extending in parallel relation.

32. The method of claim 27 wherein mounting the engine and generator includes resiliently securing the sump to structure within the boat hull.

* * * * *